US005544031A

United States Patent [19]

Blanton

[11] Patent Number: 5,544,031

[45] Date of Patent: Aug. 6, 1996

[54] BRACKET FOR DECORATIVE LIGHTS

[76] Inventor: Fred T. Blanton, P.O. Box 8216, Woodlands, Tex. 77387-8216

[21] Appl. No.: 342,742

[22] Filed: Nov. 21, 1994

[51] Int. Cl.[6] ..... F21V 21/00

[52] U.S. Cl. ..... 362/396; 362/145; 362/249; 362/432; 248/205.1

[58] Field of Search ..... 248/205.1, 205.3, 248/300; 362/226, 249, 306, 396, 432, 806, 145

[56] References Cited

U.S. PATENT DOCUMENTS

| | | | |
|---|---|---|---|
| 3,599,918 | 8/1971 | Patchett | 362/396 |
| 4,393,568 | 7/1983 | Navarro | 248/300 |
| 4,795,121 | 1/1989 | Comito | 248/300 |
| 4,905,131 | 2/1990 | Gary | 362/249 |
| 4,974,128 | 11/1990 | Prickett | 362/249 |
| 5,051,561 | 9/1991 | McWilliams et al. | 362/216 |
| 5,249,108 | 9/1993 | Gary | 362/396 |

*Primary Examiner*—Denise L. Gromada
*Assistant Examiner*—Alan Cariaso
*Attorney, Agent, or Firm*—Kenneth A. Roddy

[57] ABSTRACT

A generally L-shaped bracket for supporting and displaying a decorative light bulb and socket assembly is formed of resilient material and has a flat horizontal base portion, a contiguous vertical face portion at one end of the base portion extending outwardly perpendicular thereto, at least one aperture in the base portion for receiving various types of fasteners to secure the horizontal base portion to a generally flat surface, and an aperture in the vertical face portion defined by a circular hole near its outwardly extended end of sufficient diameter to partially encircle the neck portion of the light bulb and an adjoining narrow opening extending outwardly from the circular hole to the exterior of the vertical face portion which is smaller in width than the neck portion of the light bulb. The bracket allows a decorative light bulb and socket assembly to be installed in the bracket as a single unit without disassembly by pressing the neck portion the light bulb adjacent its socket through the narrow opening into the circular hole to become partially encircled thereby, and to be removed therefrom as a single unit by pulling the neck portion of the light bulb adjacent its socket outwardly through the narrow opening. The vertical face portion may have a tapered cross section diminishing in thickness in the vertical direction and the horizontal base portion may be provided with an opposed facing extension and may have short transverse angular projections facing toward the vertical face.

14 Claims, 2 Drawing Sheets

BRACKET FOR DECORATIVE LIGHTS

BACKGROUND OF THE INVENTION

1. Field of the Invention

This invention relates generally to brackets and holders for decorative lights, and more particularly to a generally L-shaped bracket having a flat horizontal base portion and a vertical face portion at one end thereof base with at least one aperture in the base portion for receiving various types of fasteners to secure the horizontal base portion to a generally flat surface and an aperture in the vertical face portion which allows a decorative light bulb and socket assembly to be installed and removed as a single unit without disassembly.

2. Brief Description of the Prior Art

It is widely popular during festive seasons, such as Christmas to decorate a residence or commercial building with strings of decorative lights. Conventional decorative lights include a plurality of electrical sockets along the length of an electrical wire which is connected to an electrical power source and light bulbs of various colors are screwed into the sockets.

The string of lights are usually installed on a flat surface of the residence or building by stapling the wire along its length to the flat surface and the staples often penetrate the insulated wire or sever the wire. Threaded hooks have also been used to support the string of lights.

There are several patents and commercially available brackets which may be used to install decorative lights, most of which require the light bulb to be removed from its socket, inserted through a hole in the bracket, and then to be screwed into its socket to retain the bulb and socket on the bracket, and the reverse operation is required to remove the bulb and socket from the bracket. However, this installation method is time consuming and labor intensive, especially on large commercial buildings.

There are other brackets which are configured to retain the light bulb and socket assembly in a vertical orientation which is unsatisfactory for outdoor installations because water and moisture may run down the neck of the light bulb and enter the socket through the threads of the light bulb base and socket connection which can cause corrosion or an electrical short.

Comito, U.S. Pat. No. 4,795,121 discloses a window frame light hanger device comprising an "L" shaped elongate strip having a first and second leg portion normal to each other with a series of longitudinally spaced tapered keyhole shaped openings formed in both leg portions to receive a light socket, and a series of longitudinally spaced nail holes formed in the L-shaped strip in alternating relation to the keyhole shaped openings and on the same longitudinal axis. This device would not be suitable for use in installing a large number of lights in spaced apart relation.

Gary, U.S. Pat. No. 4,851,977 discloses an L-shaped decorative light support device adapted to be inserted between the decking and shingles of a building roof and maintained therebetween solely by frictional contact. The device has an elongate flat horizontal leg and a vertical leg. The horizontal leg may be provided with transverse undulations to increase the frictional engagement between the overlapped layers of the roof structure, or may have a inwardly converging V-shaped notch which allows the horizontal leg to be inserted between the layers around a fastening device such as a roofing nail that holds the shingles. The vertical leg may have a single complete circular hole therethrough or a pair of vertically adjoined holes of different diameter. The diameter of the holes in the vertical leg is large enough to receive the base portion of a decorative light bulb therethrough before the light bulb is connected to its socket and small enough to prevent the connected light bulb and socket from passing therethrough. In other words, the bulb must be removed from its socket, inserted through the hole and then screwed into its socket, and the reverse operation is required to remove the bulb and socket from the device.

Gary, U.S. Pat. No. 4,905,131 discloses another L-shaped decorative light support device adapted to be inserted between the decking and shingles of a building roof and maintained therebetween solely by frictional contact. The device has and elongate horizontal leg and a vertical leg. The horizontal leg may have an inwardly converging V-shaped notch which allows the horizontal leg to be inserted between the layers around a fastening device such as a roofing nail that holds the shingles. The horizontal leg has a tab or tabs at the outer end which fold back over the horizontal portion at an acute angle to increase the frictional engagement between the overlapped layers of the roof structure. The vertical leg may have a single complete circular hole therethrough or a pair of vertically adjoined holes of different diameter wherein the diameter of the holes in the vertical leg is large enough to receive the base portion of a decorative light bulb therethrough before the light bulb is connected to its socket and small enough to prevent the connected light bulb and socket from passing therethrough. In other words, the bulb must be removed from its socket, inserted through the hole and then screwed into its socket, and the reverse operation is required to remove the bulb and socket from the device. Alternatively, the hole is surrounded by a tubular tapered collar to receive and frictionally engage a socket inserted from the rear of the collar.

Young, U.S. Pat. No. Des 319,575 shows a Z-shaped outdoor light holder with a ring shaped portion to receive the socket of a light bulb holder. This device would position the light bulb and socket assembly in a vertical orientation which is unsatisfactory for outdoor installations because water and moisture may run down the neck of the light bulb and enter the socket through the threads of the light bulb base and socket connection which can cause corrosion or an electrical short.

Gary, U.S. Design Pat. Nos. Des 321,124; Des 321,125; and Des 322,211 show L-shaped decorative light support devices having an elongate flat horizontal leg and a shorter flat vertical leg with a single complete circular hole through the vertical leg. These designs require that the bulb be removed from its socket, inserted through the hole and then screwed into its socket, and the reverse operation is required to remove the bulb and socket from the device. There are no apertures for attaching the horizontal leg to other surfaces.

Gary, U.S. Pat. No. Des 324,990 shows a light support bracket adapted to be inserted between the decking and shingles of a building roof and maintained therebetween solely by frictional contact. The bracket has and elongate horizontal leg, a short vertical leg adjoining the horizontal leg, and a second horizontal portion adjoining the vertical leg and extending parallel to the elongate horizontal leg to form a generally square C-shape. The second horizontal portion has a hole therethrough with an opening extending from the hole to the exterior. The elongate horizontal leg has a tab adjoined thereto by an integral hinge which allows the tab to fold back over the horizontal portion at an acute angle to increase the frictional engagement between the overlapped layers of the roof structure. This device positions the light bulb and socket assembly in a vertical orientation and there are no apertures for attaching the horizontal leg to other surfaces.

Gary, U.S. Pat. No. Des 325,866 shows a light support bracket adapted to be inserted between the decking and shingles of a building roof and maintained therebetween solely by frictional contact. The bracket has and elongate horizontal leg and a vertical tubular portion adjoining the horizontal leg. The elongate horizontal leg has a tab adjoined thereto by an integral hinge which allows the tab to fold back over the horizontal portion at an acute angle to increase the frictional engagement between the overlapped layers of the roof structure. This device positions the light bulb and socket assembly in a vertical orientation and there are no apertures for attaching the horizontal leg to other surfaces.

Gary Products, Inc. of Lubbock, Tex. has recently introduced a decorative light holder adapted to be inserted between the decking and shingles of a building roof and maintained therebetween solely by frictional contact. The holder has and elongate horizontal leg with a tab at the outer end which folds back over the horizontal portion at an acute angle to increase the frictional engagement between the overlapped layers of the roof structure. The holder has a short vertical portion perpendicular to the horizontal leg and an extension perpendicular to the short vertical portion. The extension has a pair of adjoining holes of different diameter with an opening extending from the outermost hole to the exterior. An integral hinge between the short vertical portion allows the extension to be parallel to the horizontal leg in a generally Z-shaped configuration for vertical bulb and socket installations, or to be folded to be parallel with the short vertical portion in an L-shaped configuration for horizontal bulb and socket installations. There are no apertures for attaching the horizontal leg to other surfaces.

The present invention is distinguished over the prior art and these patents in particular by a generally L-shaped bracket for supporting and displaying a decorative light bulb and socket assembly which is formed of resilient material and has a flat horizontal base portion, a contiguous vertical face portion at one end of the base portion extending outwardly perpendicular thereto, at least one aperture in the base portion for receiving various types of fasteners to secure the horizontal base portion to a generally flat surface, and an aperture in the vertical face portion defined by a circular hole near its outwardly extended end of sufficient diameter to partially encircle the neck portion of the light bulb and an adjoining narrow opening extending outwardly from the circular hole to the exterior of the vertical face portion which is smaller in width than the neck portion of the light bulb. The bracket allows a decorative light bulb and socket assembly to be installed in the bracket as a single unit without disassembly by pressing the neck portion the light bulb adjacent its socket through the narrow opening into the circular hole to become partially encircled thereby, and to be removed therefrom as a single unit by pulling the neck portion of the light bulb adjacent its socket outwardly through the narrow opening. The vertical face portion may have a tapered cross section diminishing in thickness in the vertical direction and the horizontal base portion may be provided with an opposed facing extension and may have short transverse angular projections facing toward the vertical face.

SUMMARY OF THE INVENTION

It is therefore an object of the present invention to provide a bracket for supporting and displaying a decorative light bulb and socket assembly which is easily and quickly mounted on a flat surface.

It is another object of this invention to provide a bracket for supporting and displaying a decorative light bulb and socket assembly which can be mounted on a flat surface using a variety of conventional fasteners.

Another object of this invention is to provide a bracket for supporting and displaying a decorative light bulb and socket assembly which reduces the time and labor required to install decorative light bulbs.

Another object of this invention is to provide a bracket for supporting and displaying a decorative light bulb and socket assembly which allows a decorative light bulb and socket assembly to be quickly and easily installed in the bracket and removed therefrom as a single unit without disassembly of the bulb and socket by pressing the neck portion the light bulb adjacent its socket through a narrow opening into an aperture formed in the bracket to become partially encircled thereby, and to be removed therefrom as a single unit by pulling the neck portion of the light bulb adjacent its socket outwardly through the narrow opening.

A further object of this invention is to provide a generally L-shaped bracket for supporting and displaying a decorative light bulb and socket assembly which has a flat horizontal base portion apertured for mounting on a flat surface and a vertical face portion at one end of the base portion extending perpendicular thereto apertured to receive and maintain the bulb and socket assembly generally parallel to the flat surface.

A still further object of this invention is to provide a bracket for supporting and displaying a decorative light bulb and socket assembly which is simple in construction, economical to manufacture, and rugged and durable in use.

Other objects of the invention will become apparent from time to time throughout the specification and claims as hereinafter related.

The above noted objects and other objects of the invention are accomplished by a generally L-shaped bracket for supporting and displaying a decorative light bulb and socket assembly which is formed of resilient material and has a flat horizontal base portion, a contiguous vertical face portion at one end of the base portion extending outwardly perpendicular thereto, at least one aperture in the base portion for receiving various types of fasteners to secure the horizontal base portion to a generally flat surface, and an aperture in the vertical face portion defined by a circular hole near its outwardly extended end of sufficient diameter to partially encircle the neck portion of the light bulb and an adjoining narrow opening extending outwardly from the circular hole to the exterior of the vertical face portion which is smaller in width than the neck portion of the light bulb. The bracket allows a decorative light bulb and socket assembly to be installed in the bracket as a single unit without disassembly by pressing the neck portion the light bulb adjacent its socket through the narrow opening into the circular hole to become partially encircled thereby, and to be removed therefrom as a single unit by pulling the neck portion of the light bulb adjacent its socket outwardly through the narrow opening. The vertical face portion may have a tapered cross section diminishing in thickness in the vertical direction and the horizontal base portion may be provided with an opposed facing extension and may have short transverse angular projections facing toward the vertical face.

DESCRIPTION OF THE PREFERRED EMBODIMENTS

Figure 1:
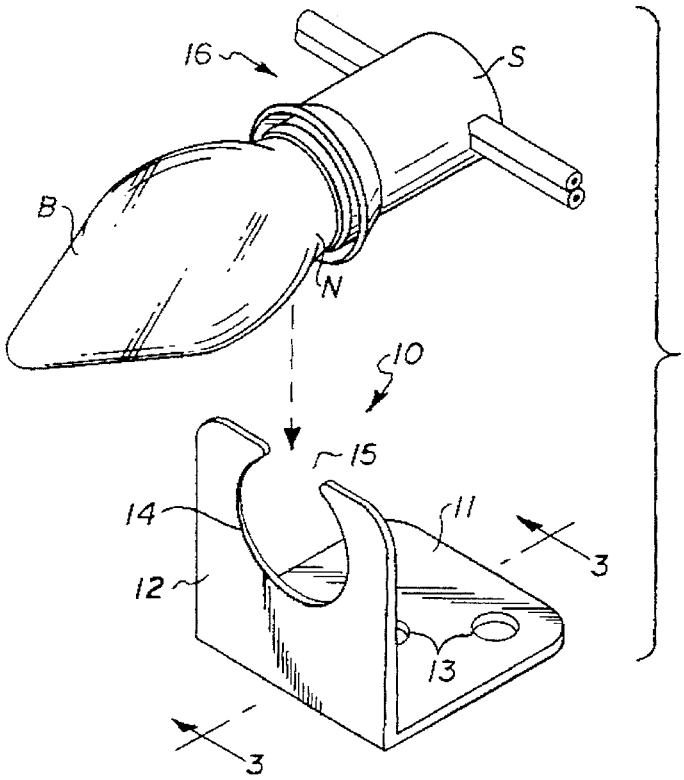
FIG. 1 is an isometric view of a first embodiment of the bracket for decorative lights in accordance with the present invention shown from the top and one end.
Figure 2:
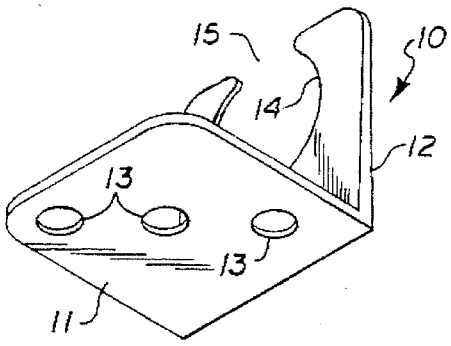
FIG. 2 is an isometric view of the embodiment of FIG. 1 shown from the bottom and opposite end.
Figure 3:
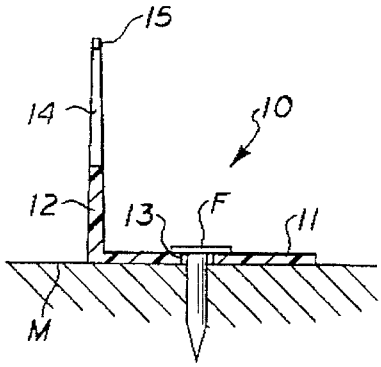
FIG. 3 is a cross section of the bracket taken along line 3—3 of FIG. 1 showing the vertical face portion having a tapered cross section diminishing in thickness in the vertical direction and also showing the bracket mounted on a flat surface by a nail fastener.

Referring to the drawings by numerals of reference, there is shown in FIGS. 1, 2, and 3, a first preferred embodiment of the bracket for decorative lights 10. The bracket 10 is a generally L-shaped member formed of resilient material having a flat horizontal base portion 11 and a contiguous vertical face portion 12 at one end of the base portion which extends outwardly perpendicular to the base portion. The horizontal base portion 11 is provided with a plurality of circular holes 13 through its surface for receiving a fastener to secure the horizontal base portion to a generally flat surface. It should be understood that the flat horizontal base portion 11 may have a single circular hole 13 through its surface rather than a plurality of spaced apart holes.

The vertical face portion 12 has an aperture near its outer end defined by a circular hole 14 sufficient diameter to partially encircle the neck portion N of a decorative light bulb B and an adjoining narrow opening 15 extending outwardly from the circular hole to the exterior of the vertical face portion. The opening 15 is slightly smaller in width than the neck portion N of the decorative light bulb B.

The decorative light bulb and socket assembly 16 is installed in the bracket 10 as a single unit without disassembly of the bulb B and socket S by pressing the neck portion N of the light bulb adjacent its socket through the narrow opening 15 into the circular hole 14 to become partially encircled thereby, and removed therefrom as a single unit by pulling the neck portion of the light bulb adjacent its socket outwardly through the narrow opening. As the neck portion N of the bulb passes through the narrow opening 15, the opposed edges of the opening spread apart due to the resiliency of the bracket material.

As shown in FIG. 3, the vertical face portion 12 preferably has a tapered vertical cross section of diminishing thickness in the vertical direction to increase flexibility of the face portion at its outwardly extended end and reduce the force required to press and pull the neck portion N of the light bulb B through the narrow opening 15 during installation and removal.

The bracket 10 may be mounted on a flat surface by various types of conventional fasteners. For example, as shown in FIG. 3, the shank of a nail or screw fastener F may secured into the flat mounting surface M through one or more circular holes 13 which would be of sufficient diameter to receive the shank portion of the nail or screw but smaller than the head of the nail or screw such that the head of the nail or screw is engaged on the top surface of the base portion 11 surrounding the hole(s) to maintain the bracket on the mounting surface.

In the embodiment having a plurality of holes 13, at least two adjacent holes may be spaced apart a sufficient distance to receive the leg portions of a wire staple whereby the head of the staple gun may be supported on the flat horizontal base portion 11 such that the leg portions of a staple are received through the adjacent holes and the horizontal portion of the staple is engaged on the surface of the base portion between the holes when the staple gun is triggered to maintain the bracket on the flat mounting surface.

Figure 4:
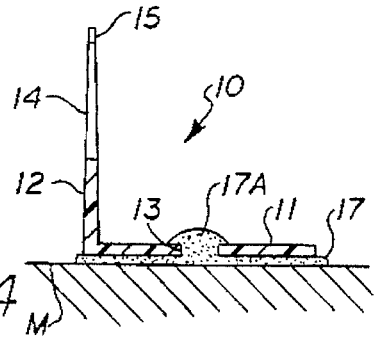
FIG. 4 is a cross section of the bracket taken along line 3—3 of FIG. 1 showing the bracket mounted on a flat surface by a layer of adhesive which extrudes through the aperture and forms a bulbous protrusion of the top surface of the base portion.

Referring now to FIG. 4, the bracket 10 may be mounted on the flat mounting surface M by applying a layer of adhesive 17 of sufficient thickness onto the flat surface and then pressing the flat base portion 11 into the adhesive such that a portion of the adhesive is extruded through the hole or holes 13 and forms a bulbous protrusion 17A on the top surface of the base portion 11 surrounding the hole or holes to maintain the bracket on the flat mounting surface.

Figure 5:
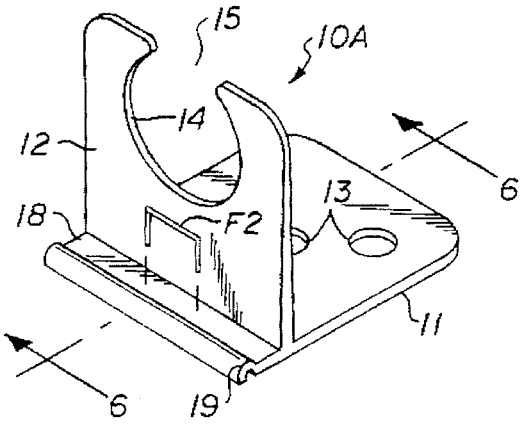
FIG. 5 is an isometric view of a second embodiment of the bracket for decorative lights having a base extension in opposed relation to the horizontal base portion and illustrating one method of mounting the bracket with a wire staple placed in the extension parallel to the vertical face portion.

FIG. 5 shows another modification of the bracket 10A which has a flat base extension 18 extending horizontally outward a short distance from the bottom end of the vertical face 12 in opposed coplanar relation to the horizontal base portion 11 and terminates at its outward end in a transverse inverted generally U-shaped ridge 19. The vertical face 12 of the embodiment of FIG. 5 has the same circular hole 14 and narrow opening 15 near its outer end as previously described and may also have tapered vertical cross section of diminishing thickness in the vertical direction.

Figure 6:
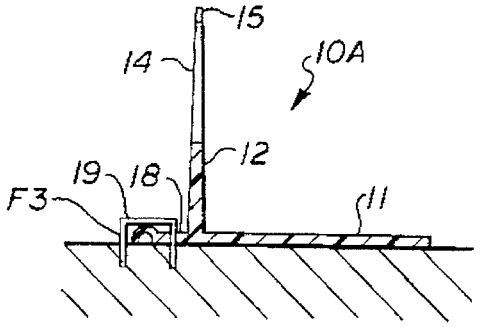
FIG. 6 is a cross section of the bracket taken along line 6—6 of FIG. 5 showing the bracket mounted on a flat surface and illustrating a second method of mounting the bracket with a wire staple placed normal to the vertical face portion.

The flat base extension 18 may be utilized for stapling the bracket 10 onto the mounting surface by two different methods. As shown in FIG. 5, a wire staple fastener F2 may be placed through the flat base extension 18 parallel to the vertical face portion 12 with a staple gun. Alternatively, as shown in FIG. 6, a wire staple fastener F3 may be placed normal to the vertical face portion 12. In the latter method, the upstanding inverted U-shaped ridge 19 at the outer end of the flat base extension serves as a guide for the staple gun. Most conventional heavy duty staple guns, such as an Arrow model T-25 have a groove at the center of the head. The groove on the head of the staple gun is supported on the ridge 19 and when the gun is triggered, the leg portions of the staple straddle the ridge and the horizontal portion of the staple is engaged on the ridge.

Figure 7:
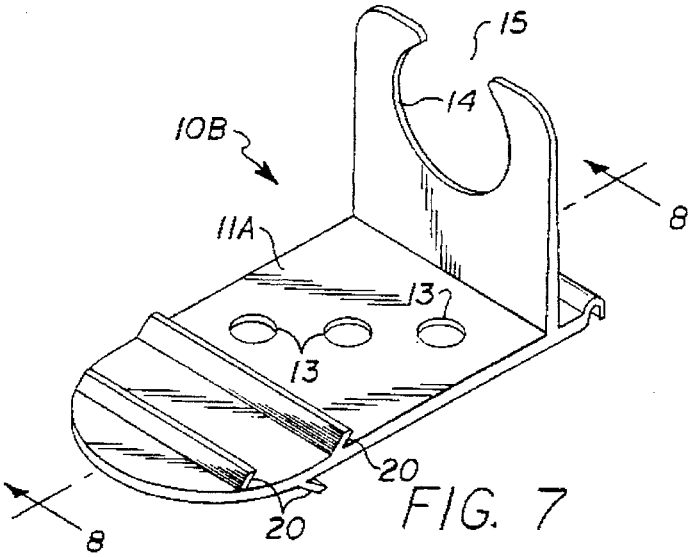
FIG. 7 is an isometric view of a third embodiment of the bracket for decorative lights having a series of longitudinally spaced short flat projections extending transversely across the width of the flat horizontal base portion and projecting outwardly from the top and bottom surfaces thereof.
Figure 8:
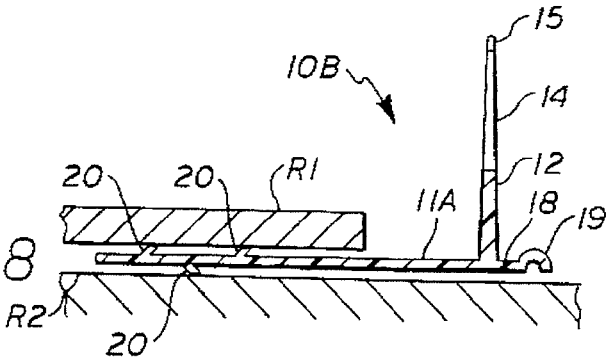
FIG. 8 is a cross section of the bracket of FIG. 6 taken along line 8—8 of FIG. 7 showing the bracket mounted between two overlapping layers of a roof structure.

FIGS. 7 and 8 show another modification of the bracket 10B which has an extended flat horizontal base portion 11A with a series of longitudinally spaced short flat projections 20 extending transversely across the width of the flat horizontal base near its outer end. A best seen in FIG. 8, the projections 20 project outwardly from the top and bottom surfaces of the base portion 11A at an acute angle with their outer ends facing in the direction of the vertical face 12. The vertical face 12 of the embodiment of FIGS. 7 and 8 has the same circular hole 14 and narrow opening 15 near its outer end as previously described and may also have tapered vertical cross section of diminishing thickness in the vertical direction, and may or may not have the base extension 18 and ridge 19. Preferably, the flat horizontal base portion 11A has one or more circular holes 13 as previously described.

The transverse projections 20 and holes 13 allow the bracket to be installed between two overlapping layers of a roof structure R1 and R2, by slipping it under a shingle, flashing, or other structural member, and further secured by placing a nail or other fastener through one or more holes 13 or, if provided with the extension 18 and ridge 19, further secured by stapling, such that the bracket is not held solely by friction.

It should be understood that the bracket in accordance with the present invention may be provided with a combination of the features described above. For example, the bracket may have a vertical face with a cross section of diminishing thickness in the vertical direction with a circular hole and narrow opening near its outer end, a flat horizontal base portion with a plurality of holes through its surface and a series of longitudinally spaced short flat projections extending transversely across the width of the base portion near its outer end, and a flat base extension extending horizontally outward a short distance from the bottom end of the vertical face in opposed coplanar relation to the horizontal base portion and terminating at its outward end in a transverse inverted generally U-shaped ridge.

While this invention has been described fully and completely with special emphasis upon a preferred embodiment, it should be understood that within the scope of the appended claims the invention may be practiced otherwise than as specifically described herein.

I claim:

1. A bracket for supporting and displaying a decorative light bulb and socket assembly comprising:

a generally L-shaped bracket formed of resilient material having a flat horizontal base portion and a contiguous vertical face portion at one end of said base portion extending outwardly perpendicular to said base portion;

said vertical face portion having a tapered vertical cross section of diminishing thickness in the vertical direction to increase flexibility of said face portion at its outwardly extended end and reduce the force required to press and pull the neck portion of the light bulb through said narrow opening during installation and removal;

at least one aperture in said horizontal base portion for receiving fastening means to secure said horizontal base portion to a generally flat surface; and an aperture in said vertical face portion defined by a circular hole near its outwardly extended end of sufficient diameter to partially encircle a neck portion of a decorative light bulb and an adjoining narrow opening extending outwardly from said circular hole to the exterior of said vertical face portion and having a width smaller than the neck portion of the decorative light bulb; whereby a decorative light bulb and socket assembly is installed in said bracket as a single unit without disassembly by pressing the neck portion the light bulb adjacent its socket through said narrow opening into said circular hole to become partially encircled thereby, and removed therefrom as a single unit by pulling the neck portion of the light bulb adjacent its socket outwardly through said narrow opening.

2. The bracket according to claim 1 wherein:

said flat horizontal base portion has a plurality of said apertures in spaced apart relation for receiving various fastener means selected from the group consisting of staples, nails, screws, and adhesives.

3. The bracket according to claim 1 wherein:

said flat horizontal base portion has at least two said apertures spaced apart a sufficient distance to receive leg portions of a wire staple and such that the leg portions of a staple are received through said apertures and a horizontal portion of the staple is engaged on the surface of said base portion between said apertures when a staple is installed thereon to maintain said bracket on the flat surface.

4. The bracket according to claim 1 wherein:

said at least one aperture in said flat horizontal base portion is a circular hole of sufficient diameter to receive a shank portion of a headed fastener but smaller than a head portion of the fastener such that the shank portion is received through said aperture and the head portion of the fastener is engaged on the surface of said base portion surrounding said aperture when the headed fastener is installed in said aperture to maintain said bracket on the flat surface.

5. The bracket according to claim 1 wherein:

said at least one aperture in said flat horizontal base portion is a circular hole and said bracket is mounted on the flat surface by a layer of adhesive of sufficient thickness to be extruded through said aperture when the bottom surface of said base portion is pressed onto the adhesive layer and form a bulbous protrusion of the top surface of said base portion surrounding said aperture to maintain said bracket on the flat surface.

6. A bracket for supporting and displaying a decorative light bulb and socket assembly comprising:

a generally L-shaped bracket formed of resilient material having a flat horizontal base portion and a contiguous vertical face portion at one end of said base portion extending outwardly perpendicular to said base portion;

at least one aperture in said horizontal base portion for receiving fastening means to secure said horizontal base portion to a generally flat surface;

a flat base extension extending horizontally outward a distance from the bottom end of said vertical face portion in opposed coplanar relation to said horizontal base portion for receiving a wire staple fastener to maintain said bracket on the flat surface; and an aperture in said vertical face portion defined by a circular hole near its outwardly extended end of sufficient diameter to partially encircle a neck portion of a decorative light bulb and an adjoining narrow opening extending outwardly from said circular hole to the exterior of said vertical face portion and having a width smaller than the neck portion of the decorative light bulb; whereby a decorative light bulb and socket assembly is installed in said bracket as a single unit without disassembly by pressing the neck portion the light bulb adjacent its socket through said narrow opening into said circular hole to become partially encircled thereby, and removed therefrom as a single unit by pulling the neck portion of the light bulb adjacent its socket outwardly through said narrow opening.

7. The bracket according to claim 6 further comprising:

an upstanding inverted U-shaped ridge at the outer end of said flat base extension extending transversely across its width to support a staple gun head and serve as a guide to position the staple gun head relative to said flat base extension such leg portions of a staple straddle said ridge and a horizontal portion of the staple is engaged on said ridge when the staple gun is triggered to maintain said bracket on the flat surface.

8. The bracket according to claim 6 further comprising:

a series of longitudinally spaced short flat projections extending transversely across the width of said flat horizontal base portion near its outer end and projecting outwardly from the top and bottom surfaces thereof at an acute angle and said flat projections having outer ends facing in the direction of said vertical face for frictionally engaging said flat horizontal base portion between two overlapping layers of a roof structure.

9. The bracket according to claim 6 wherein:

said vertical face portion has a tapered vertical cross section of diminishing thickness in the vertical direction to increase flexibility of said face portion at its outwardly extended end and reduce the force required to press and pull the neck portion of the light bulb through said narrow opening during installation and removal.

10. A bracket for supporting and displaying a decorative light bulb and socket assembly comprising:

a generally L-shaped bracket formed of resilient material having a flat horizontal base portion and a contiguous vertical face portion at one end of said base portion extending outwardly perpendicular to said base portion, said vertical face portion having a tapered vertical cross section of diminishing thickness in the vertical direction;

a plurality of spaced apart apertures in said flat horizontal base portion configured to receive various fastener means selected from the group consisting of staples, nails, screws, and adhesives for securing said horizontal base portion to a generally flat surface; and an aperture in said vertical face portion defined by a circular hole near its thinner outwardly extended end of sufficient diameter to partially encircle a neck portion of a decorative light bulb and an adjoining narrow opening extending outwardly from said circular hole to the exterior of said vertical face portion and having a width smaller than the neck portion of the decorative light bulb; whereby a decorative light bulb and socket assembly is installed in said bracket as a single unit without disassembly by pressing the neck portion the light bulb adjacent its socket through said narrow opening into said circular hole to become partially encircled thereby, and removed therefrom as a single unit by pulling the neck portion of the light bulb adjacent its socket outwardly through said narrow opening.

11. The bracket according to claim 10 further comprising:

a flat base extension extending horizontally outward a distance from the bottom end of said vertical face portion in opposed coplanar relation to said horizontal base portion for receiving a wire staple fastener to maintain said bracket on the flat surface.

12. The bracket according to claim 11 further comprising:

an upstanding inverted U-shaped ridge at the outer end of said flat base extension extending transversely across its width to support a staple gun head and serve as a guide to position the staple gun head relative to said flat base extension such that leg portions of a staple straddle said ridge and a horizontal portion of the staple is engaged on said ridge when the staple gun is triggered to maintain said bracket on the flat surface.

13. The bracket according to claim 10 further comprising:

a series of longitudinally spaced short flat projections extending transversely across the width of said flat horizontal base portion near its outer end and projecting outwardly from the top and bottom surfaces thereof at an acute angle and said flat projections having outer ends facing in the direction of said vertical face portion for frictionally engaging said flat horizontal base portion between two overlapping layers of a roof structure.

14. The bracket according to claim 10 further comprising:

a flat base extension extending horizontally outward a distance from the bottom end of said vertical face portion in opposed coplanar relation to said horizontal base portion for receiving a wire staple fastener; and a series of longitudinally spaced short flat projections extending transversely across the width of said flat horizontal base portion near its outer end and projecting outwardly from the top and bottom surfaces thereof at an acute angle and said flat projections having outer ends facing in the direction of said vertical face portion.

* * * * *